US007721940B2

(12) United States Patent
Moenne-Loccoz et al.

(10) Patent No.: US 7,721,940 B2
(45) Date of Patent: May 25, 2010

(54) CARDBOARD BOX HAVING AN EXPANDABLE VOLUME

(75) Inventors: Guillaume Moenne-Loccoz, Paris (FR); Alexandre Nisse, La Fleche (FR); Christophe Peynet, L'Hay les Roses (FR)

(73) Assignee: NEOPOST Technologies, Bagneux (FR)

( * ) Notice: Subject to any disclaimer, the term of this patent is extended or adjusted under 35 U.S.C. 154(b) by 11 days.

(21) Appl. No.: 11/873,798

(22) Filed: Oct. 17, 2007

(65) Prior Publication Data

US 2008/0093432 A1 Apr. 24, 2008

(30) Foreign Application Priority Data

Oct. 20, 2006 (FR) ..... 06 54403

(51) Int. Cl.
*B65D 5/355* (2006.01)
*B65D 43/08* (2006.01)

(52) U.S. Cl. ..... 229/101; 229/125.29

(58) Field of Classification Search ..... 229/101, 229/125.19, 125.29, 125.28, 125.32; 206/814
See application file for complete search history.

(56) References Cited

U.S. PATENT DOCUMENTS 2,718,996 A * 9/1955 Jamieson ..... 229/125.29
2,973,127 A * 2/1961 Royce ..... 229/125.19
3,195,798 A 7/1965 Wilson
4,146,167 A 3/1979 Pascus
4,272,009 A * 6/1981 Bamburg et al. ..... 229/101
4,946,093 A 8/1990 Moorman
5,121,877 A * 6/1992 Bodary et al. ..... 229/125.19
5,148,940 A * 9/1992 Mendise ..... 229/101
5,577,659 A * 11/1996 Ades ..... 229/125.29
6,164,526 A * 12/2000 Dalvey ..... 229/101
2003/0172561 A1 * 9/2003 Miller ..... 40/312

FOREIGN PATENT DOCUMENTS

AU 510 457 B2 1/1978
FR 1 340 765 A 10/1963
FR 2 383 838 A 10/1978

* cited by examiner

*Primary Examiner*—Gary E Elkins
(74) *Attorney, Agent, or Firm*—Sughrue Mion, PLLC

(57) ABSTRACT

A box for packaging objects, said box including a first belt made up of four vertical panels and terminated by a return tab, each vertical panel being extended by two opposite side flaps designed so that, once they have been folded over at right angles, they form a bottom and a first top for said box, each of at least two of the side flaps having a cutout on a fold line parallel to its outside edge, which cutout enables a tongue to be detached from said flap, said box further including a second belt made up of four other vertical panels and terminated by another return tab, each vertical panel being extended by a single other side flap designed to form a second top for the box, each of two other side flaps being provided with at least one opening or at least one notch for receiving said tongues.

2 Claims, 2 Drawing Sheets

CARDBOARD BOX HAVING AN EXPANDABLE VOLUME

TECHNICAL FIELD

The present invention relates to the packaging sector and it relates more particularly to a box made of cardboard or of any other semi-rigid material, and whose volume can vary as a function of its contents.

PRIOR ART

Currently, for transport reasons, many cardboard boxes have standardized dimensions. It is therefore common for the objects disposed in such boxes not to use all of the available space, and for it thus to be necessary to wedge the objects and to fill the unused volume with polystyrene or with any other filler material.

Also today, since production sites are increasingly specialized, it is frequent for it to be necessary, when packaging a product, for said product to go via a plurality of said sites. In practice, when a product needs to go via two distinct production sites before it is sent to its final destination, in order to avoid having to change the packaging at each site, the first portion of the product coming from the first production site is already placed in the shipment box that is to be sent to the final destination. That cardboard box is thus overdimensioned relative to the product packaged at the first site, and the volume that is not yet used is often filled with an empty box or with a polystyrene cube dimensioned to be of the same size as the remaining volume. Once at the second production site, the cardboard box is opened, the filler element is discarded and the second portion of the product is disposed in the space vacated in that way. The cardboard box as finally filled with the finished product can then be closed for shipment to its destination.

Unfortunately, although that solution avoids both using two different shipment boxes and also complicated handling operations for unpacking and repacking the product from one site to the other, it suffers from a handicap in terms of cost. Since the transport costs, in particular the international transport costs, are a function of transported volume rather than of transported weight, the transport between the first production site and the second production site is more expensive than it should be and, depending on the destinations, the extra cost can be as high as to cancel out the saving achieved in the handling costs at the second production site by using a single transport box.

OBJECT AND DEFINITION OF THE INVENTION

The present invention proposes to mitigate that drawback with a cardboard box whose volume can vary with varying transported object volume.

This object is achieved by a box for packaging objects, said box including a first belt made up of four vertical panels and terminated by a return tab, each vertical panel being extended by two opposite side flaps designed so that, once they have been folded over at right angles, they form a bottom and a first top for said box, wherein each of at least two of said side flaps has a cutout on a fold line parallel to its outside edge, which cutout enables a tongue to be detached from said flap, and wherein said box further includes a second belt made up of four other vertical panels and terminated by another return tab, each vertical panel being extended by a single other side flap designed to form a second top for said box, each of two of said other side flaps being provided with at least one opening or at least one notch for receiving said tongues.

With this configuration, the initial volume of the box corresponds precisely to the dimensions of the object that it contains, and the initial transport cost is thus optimized, addition of the lid-forming additional portion making it possible to form a box that has the desired final volume and that has improved rigidity due to the presence of the tongues.

Preferably, two tongues are formed on respective ones of the two side flaps of smaller width designed to form said first top, said two tongues being designed to co-operate with two openings provided on respective ones of two fold lines between the adjacent vertical panels and the two smaller-width side flaps designed to form said second top. Two other tongues are formed on each of the two larger-width side flaps designed to form said first top, these four other tongues being designed to co-operate in pairs with four notches provided in opposite sides of the two smaller-width side flaps designed to form said second top.

Advantageously, said side flaps forming the first top of the box have a height greater than the height of said opposite side flaps forming the bottom of the box.

The invention also provides a blank made of cardboard or of any other semi-rigid material for manufacturing a box as described above, said blank including a belt made up of four vertical panels and terminated by a return tab, each vertical panel being extended by a single side flap, two of said side flaps having a size adapted so that, once they are folded over, they form a top for the belt of vertical panels, each of the other two of said side flaps being provided with an opening formed on the fold line between it and the adjacent vertical panel.

Advantageously, said other two side flaps are also provided with notches formed in two opposite sides of said side flaps.

BRIEF DESCRIPTION OF THE DRAWINGS

Other characteristics and advantages of the present invention appear more clearly from the following description given by way of non-limiting indication, and with reference to the accompanying drawings, in which.

DETAILED DESCRIPTION OF A PREFERRED EMBODIMENT

The invention is based on adding a lid-forming additional portion to a basic structure of a cardboard box designed for packaging various objects.

Figure 1:
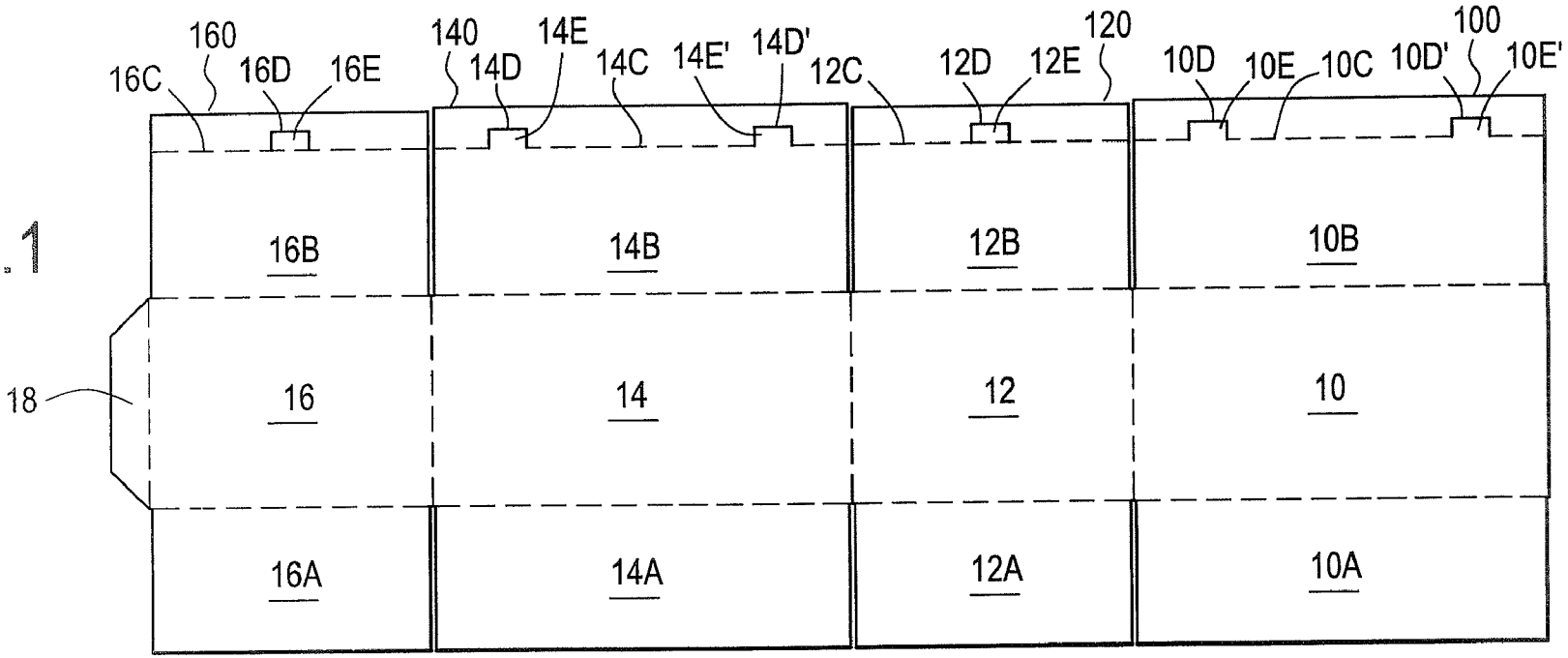
FIG. 1 shows a cardboard blank from which a basic structure is formed for the cardboard box of the invention.

FIG. 1 shows the blank for said basic structure with the cutouts (uninterrupted lines) and the folds (dashed lines) necessary for assembling it.

This blank is substantially like the blank for a standard cardboard box except for specific folds and cutouts formed on the four side flaps of the top of said box.

Conventionally, the rectangular block shaped box, made of cardboard or of any other semi-rigid material (e.g. of PVC), includes a belt made up of four vertical panels 10, 12, 14, 16, and terminated by a return tab 18, each panel being extended, over almost its entire width (and not over its entire width so as to enable folding to take place in view of the thickness of the material) by two opposite side flaps 10A, 10B; 12A, 12B;

14A, 14B; 16A, 16B designed to form a bottom and a first top for the box. The height of each of the bottom flaps is conventionally such that, once folded over at right angles, the side flaps 10A, 14A corresponding to the longitudinal vertical panels (i.e. to the wider panels 10, 14) can form a complete bottom with touching edges.

However, in accordance with the invention, the height of each of the flaps of the top is preferably larger so that, once folded over at right angles, the side flaps 10B, 12B, 14B, 16B corresponding both to the longitudinal panels 10, 14 and to the transverse panels 12, 16 can form a complete top whose edges are not merely touching but rather overlap. The level of overlap depends on the chosen height which also defines the additional storage volume. More precisely, each of the side flaps is provided with a fold line 10C, 12C, 14C, 16C parallel to the outside edge of the flap 100, 120, 140, 160, and distant from the fold line between said flap and the adjacent vertical panel by a distance preferably equal to the height of each of the opposite flaps 10A, 12A, 14A, 16A forming the bottom of the box.

Similarly, in accordance with the invention, each of at least two of the side flaps extending the transverse panels (i.e. the panels of smaller width) 12, 16 or the longitudinal panels (i.e. the panels of larger width) 10, 14 is provided with at least one cutout 12D, 16D (in the transverse flaps), 10D, 10D'; 14D, 14D' (in the longitudinal flaps) formed on the fold line 10C, 12C, 14C, 16C and making it possible to detach a tongue 10E, 10E', 12E, 14E, 14E', 16E from said flap, the advantage of which tongue appears on reading the description below.

Handles (not shown) stuck to two opposite longitudinal or transverse flaps can further be provided in order to enable ties to pass through or more simply in order to enable the box to be easy to take hold of by hand.

Figure 2:
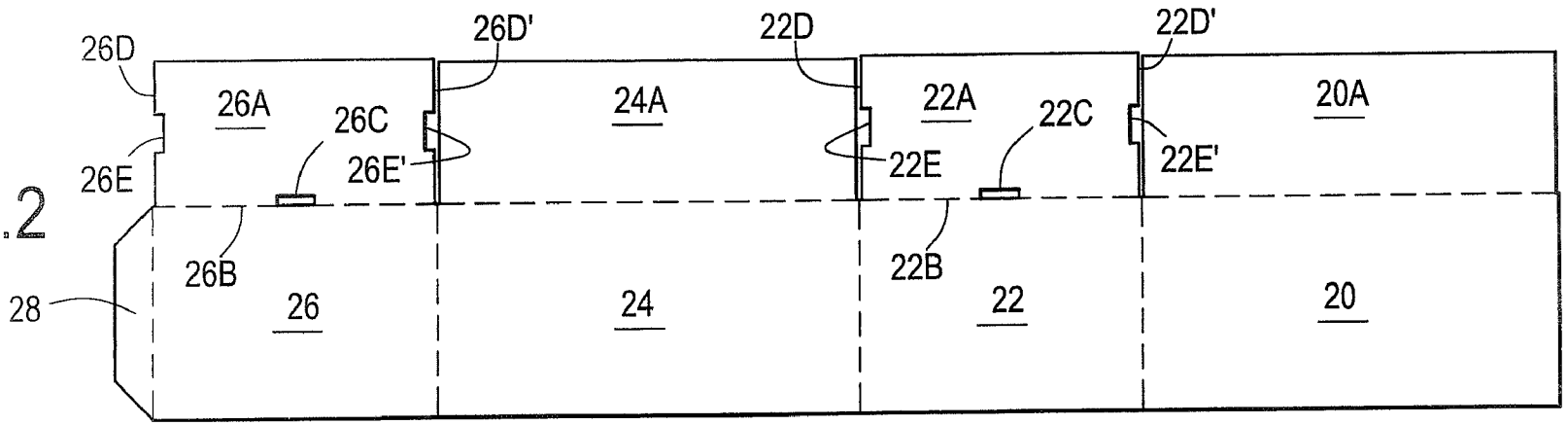
FIG. 2 shows a cardboard blank from which a lid-forming additional portion of the cardboard box of the invention is formed.

FIG. 2 shows the blank of the lid-forming additional portion that is specific to the invention.

This portion also includes a belt made up of four vertical panels 20, 22, 24, 26, and terminated by a return tab 28. However, this portion does not have any bottom flaps, each vertical panel being extended over its width (naturally, as above, ignoring the width of the material) by only one side flap 20A, 22A, 24A, 26A, designed to form a second top for the box. In order for the second top to fit exactly over the basic structure, the dimensions of the second belt are the same (ignoring the thickness of the material) as the dimensions of the belt of the basic structure. However, the height of each of the side flaps of said second top is such that, once folded over, the side flaps 20A and 24A corresponding to the longitudinal panels 20, 24 can form a top whose edges are touching rather than being overlapping as in the first top.

In accordance with the invention, in order to impart greater rigidity to the box as closed, each of the other two side flaps 22A, 26A corresponding to the transverse panels 22, 26 firstly has an opening 22C, 26C on the fold line 22B, 26B between said flap and the adjacent vertical panel 22, 26, and secondly has notches 22E, 22E'; 26E, 26E' on respective ones of its two opposite sides 22D, 22D'; 26D, 26D', said openings being designed to receive respective ones of the tongues 12E, 16E on the side flaps of the basic structure, and said notches being designed to receive the tongues 10E, 10E', 14E, 14E'. Thus, the side flaps 10B, 12B, 14B, 16B are held in alignment with the vertical panels 10, 12, 14, 16 pressed against the second belt, thereby stiffening the box as a whole, in particular in the event of impact.

Figure 4:
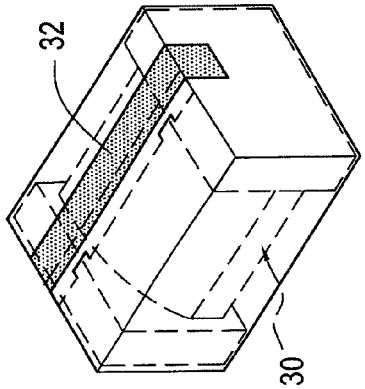
Figure 3:
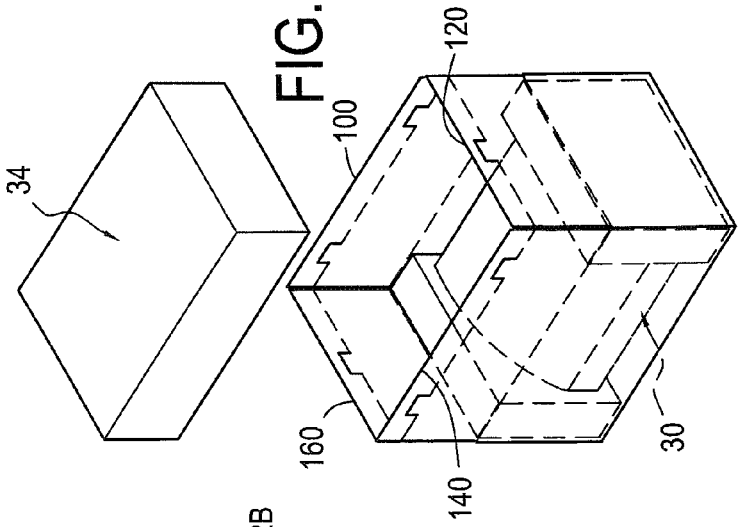
Figure 3:
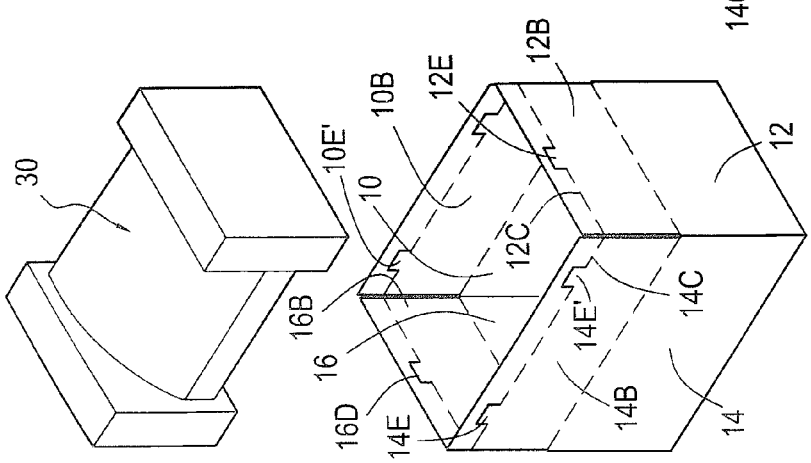

FIGS. 3 to 6 show various steps in assembly of the box. The basic structure of the box is formed firstly, on the first production, assembly, or shipment site, e.g. by folding the side flaps 10A, 12A, 14A, 16A over at right angles, and then each assembly formed in this way is itself folded over at right angles about the fold lines between all of the panels 10, 12, 14, 16. The return tab 18 is bonded with adhesive to the first panel 10, and the bottom of the box can in turn be formed by bonding with adhesive the side flaps 10A, 14A, for example, to the side flaps 12A, 16A (FIG. 3). At this stage, the box can be filled with the object 30 to be shipped, and, once said object has been put in place, and, if necessary, wedged, inside, the two top flaps 12B, 16B are folded over at right angles, and then the other two top flaps 10B, 14B are, in turn, folded over at right angles, the box then being closed with a strip of adhesive tape 32 prior to being shipped to the second production or assembly site (FIG. 4).

Figure 6:
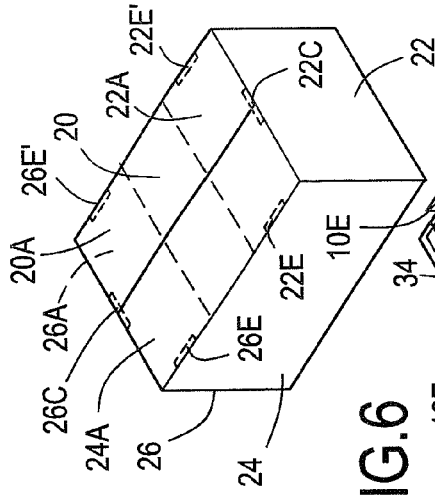
FIGS. 3 to 7 show various steps in successively placing two portions of a product in the cardboard box of the invention.

Once it has reached the second production or assembly site, the box is opened and the four side flaps are then raised into alignment with the vertical panels 10, 12, 14, 16, making it possible to add a second object 34 (FIG. 5), for example, above the first object 30. In order to serve as a support for the lid-forming additional portion, the ends of the side flaps are then folded over at right angles about the fold lines 10C, 12C, 14C, 16C, except for the tongues 10E, 10E', 12E, 14E, 14E', 16E which, because of the openings 22C, 26C and of the notches 22E, 22E'; 26E, 26E' provided in the lid-forming additional portion, can remain in the vertical position in alignment with the panels 10, 12, 14, 16. In parallel, the lid-forming additional portion is formed by folding over the side flaps 20A, 22A, 24A, 26A at right angles, and then each assembly formed in this way is in turn folded over at right angles about the fold lines between all of the vertical panels 20, 22, 24, 26, the return tab 28 being bonded with adhesive to the first panel 20, and the side flaps 20A, 24A being held touching (FIG. 6).

Figure 7:
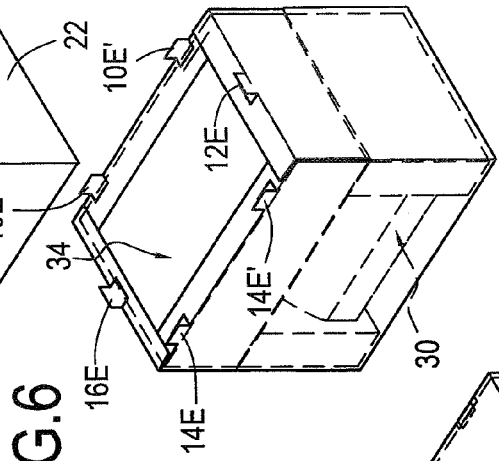
Figure 5:
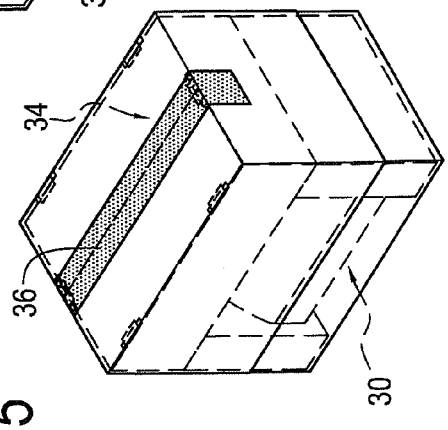

FIG. 7 shows the box as closed and as ready to be shipped with its new top closed by a new strip of adhesive tape 36. The lid-forming additional portion has been laid on the basic structure, and it is held in position by the tongues 10E, 10E', 12E, 14E, 14E', 16E that pass through the openings 22C, 26C, and through the notches 22E, 22E', 26E, 26E', the top also resting on the folded-over edges of the side flaps 10B, 12B, 14B, 16B of the basic structure.

The above-described box thus makes it possible, particularly simply, to increase the loading volume of the box by up to 50%. It should be noted that, although in the above description there are six positioning tongues, that number is naturally non-limiting, and it is quite possible either to form additional tongues or to limit their number, e.g. by disposing at least two tongues on each of the smaller-width opposite flaps.

The invention claimed is:

1. A box for packaging objects, said box including:

a first belt made up of four vertical panels and terminated by a return tab, each vertical panel of said first belt being extended by two opposite side flaps designed so that, once they have been folded over at right angles, they form a bottom and a first top for said box, wherein each of at least two of said side flaps designed to form said first top has a cutout on a fold line parallel to its outside edge, which cutout enables a tongue to be detached from said flap, wherein said box further includes a second belt made up of four other vertical panels and terminated by another return tab, each vertical panel of said second belt being extended by a single other side flap designed to form a second top for said box, each of two of said other side flaps being provided with at least one opening or at least one notch for receiving said tongues, wherein one tongue is formed on each of two side flaps designed to form said first top, said two tongues being designed to cooperate with two openings provided on two side flaps designed to form said second top and on two fold lines separating the adjacent vertical panels of said second belt from said side flaps designed to form said second top, and wherein two other tongues are formed on each of two remaining side flaps designed to form said first top, these four other tongues being designed to cooperate in pairs with four notches provided in opposite sides of the same two side flaps designed to form said second top.

2. A box according to claim 1, wherein said side flaps forming the first top of the box have a height greater than the height of said opposite side flaps forming the bottom of the box.

* * * * *